United States Patent [19]

Greiner et al.

[11] Patent Number: 4,664,949

[45] Date of Patent: May 12, 1987

[54] PRINTING MACHINE FOR PRINTING AND FINAL VARNISHING OF SHEETS

[75] Inventors: Harry M. Greiner; Claus Simeth, both of Offenbach, Fed. Rep. of Germany

[73] Assignee: M.A.N-Roland Druckmaschinen Aktiengesellschaft, Fed. Rep. of Germany

[21] Appl. No.: 756,917

[22] Filed: Jul. 18, 1985

Related U.S. Application Data

[63] Continuation of Ser. No. 564,631, Dec. 22, 1983, abandoned.

[30] Foreign Application Priority Data

Dec. 27, 1982 [DE] Fed. Rep. of Germany ..... 3248232

[51] Int. Cl.[4] ..... B05D 1/00; B41F 23/08

[52] U.S. Cl. ..... 427/210; 118/46; 427/211; 427/288; 101/229

[58] Field of Search ..... 118/46, 249, 262; 101/229, 331, 416 B; 427/210, 258, 211, 288

[56] References Cited

FOREIGN PATENT DOCUMENTS 504639 7/1954 Canada ..... 101/229

*Primary Examiner*—John P. McIntosh

*Attorney, Agent, or Firm*—Leydig, Voit & Mayer

[57] ABSTRACT

In accordance with the invention a varnishing unit in a printing machine is provided which simultaneously varnishes and perfects printing sheets. The varnishing unit comprises a rotating impression cylinder in contact with a rotating varnishing cylinder to create a nip between the two cylinders through which sheets are individually drawn. In order to perfect each sheet at the nip, the impression cylinder has at least one plate or a blanket secured to its surface. Depending on whether a plate or a blanket is secured to the impression cylinder, an appropriate dampening and inking means is provided. Similarly, the varnishing cylinder is supplied a controlled quantity of varnish by a varnishing means.

7 Claims, 5 Drawing Figures

PRINTING MACHINE FOR PRINTING AND FINAL VARNISHING OF SHEETS

This application is a continuation, of application Ser. No. 564,631, filed Dec. 22, 1983 now abandoned.

FIELD OF THE INVENTION

This invention generally relates to printing machines and, more particularly, to varnishing units in printing machines.

BACKGROUND OF THE INVENTION

Typically, a varnishing unit in a printing machine is constructed as a separate unit disposed after the printing units and before the delivery unit of the machine. In many printing machines of this kind perfecting is possible only by turning the sheet over; for example, German Auslegeschrift No. 2,608,661 discloses a printing machine of this type. But in such printing machines the perfecting process subjects the previously applied varnish to pressure which destroys the smooth sheet surface produced by varnishing. Other printing machines which include varnishing as a final operation have no provision for perfecting; therefore, varnish can be applied without difficulty. Examples of such printing machines are disclosed in German Patentschrift Nos. 2,020,584 and 2,345,183.

SUMMARY OF THE INVENTION

It is a primary object of this invention to provide a printing machine which may perfect sheets without destroying the sheet's varnish coating. In this connection, it is a related object of this invention to perfect and varnish sheets without requiring the sheets to be turned over.

It is another object of this invention to provide a printing machine with a perfecting and varnishing operation relatively free of any tendency for the sheets to roll up on the printing machine's rollers and/or to stretch upon removal from a roller.

A further object of this invention is to provide a printing machine which, while attaining the foregoing objectives, is inexpensive to manufacture and simple in design.

Other objects and advantages of this invention will become apparent from the following detailed description and the accompanying drawings.

In accordance with the invention a varnishing unit in a printing machine is provided which simultaneously varnishes and perfects printing sheets. The varnishing unit comprises a rotating impression cylinder in contact with a rotating varnishing cylinder to create a nip between the two cylinders through which sheets are individually drawn. In order to perfect each sheet at the nip, the impression cylinder has at least one plate or a blanket secured to its surface. Depending on whether a plate or a blanket is secured to the impression cylinder, an appropriate dampening and inking means is provided. Similarly, the varnishing cylinder is supplied a controlled quantity of varnish by a varnishing means.

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
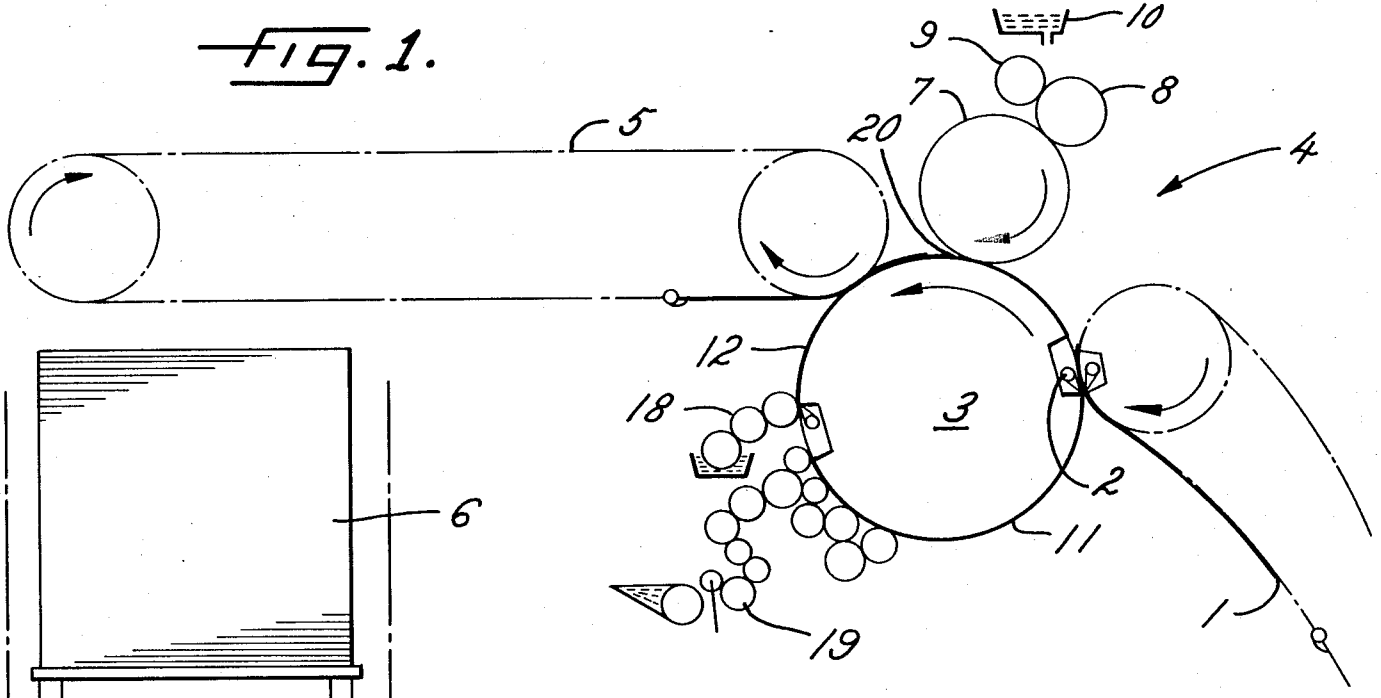
FIG. 1 is a schematic diagram of a prior art printing machine utilizing three printing units to print and perfect the printing sheets prior to a final step of varnishing.
Figure 2:
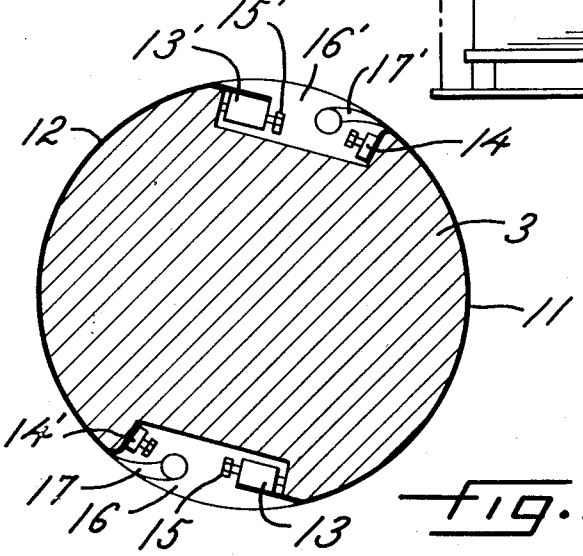
FIG. 2 is a schematic diagram of a prior art printing machine which includes two two-color printing units succeeded by a varnishing unit.

Turning now to the drawings and referring first to FIGS. 1 and 2, conventional printing machines typically comprise a series of printing units followed by a varnishing unit which provides a coat of varnish to one side of the printed sheet. In FIG. 1 the printing machine perfects each sheet before a final varnishing operation. In the printing machine of FIG. 2, there is no perfecting of the sheets. To aid in the understanding of the operation of the printing machine in FIG. 1, a double-ended arrow is utilized to indicate the position of the sheets; in particular, the solid arrow head indicates a first end of the sheets and the open arrow head indicates a second end of the sheets.

In operation, the sheets are individually transferred from a feed station 11 to a first printing unit 13 where each of the sheets is printed on a first side. From the printing unit 13, each sheet is flipped by a conventional mechanism 15 and thereafter transferred to a second printing unit 17 which prints on the sheet's second side. The second side of the sheets is again printed by a third printing unit 19. As a final step, the second side of each sheet is varnished by varnishing unit 21. The well-known disadvantages of perfecting before varnishing will be appreciated by those skilled in the art of printing. After each sheet is varnished it is conveyed to a delivery station 23.

The four-print process in FIG. 2 is without a perfecting step, so that only one side of each sheet receives print. A feed station 25 stores fresh sheets in a stack and individually delivers them to a first printing unit 27 wherein each sheet is twice printed on a first side. From the first printing unit 27, the sheets are transferred to a second printing unit 29 which also twice prints each sheet on the first side. As a final step, each sheet is varnished on its first side by varnishing unit 31. The sheets are thereafter dried and delivered to a delivery station 33.

Figure 3:
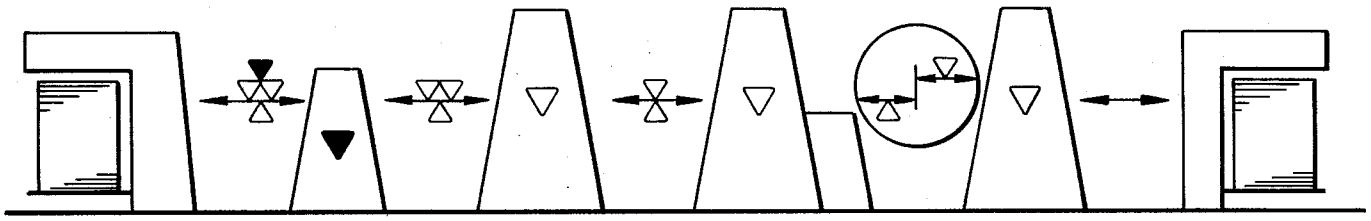
FIG. 3 is a schematic diagram of a varnishing unit according to the invention which utilizes a two-cylinder di-litho perfecting process.
Figure 4:
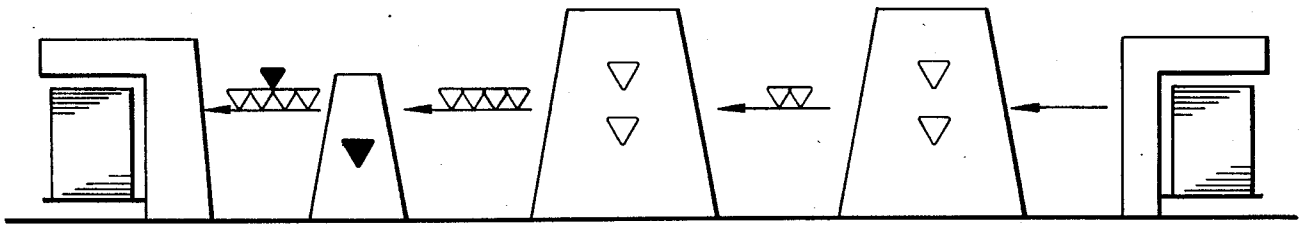
FIG. 4 is an enlarged cross-section of the impression cylinder in FIG. 3 showing securing mechanisms for tensioning and clamping printing plates to the cylinder surface.

In the varnishing unit 35 of FIG. 3, a feed transport system 37, comprising a rotating cylinder 39 and an endless belt 41, transfers the individual sheets 43 from a preceding printing unit (not shown) to the varnishing unit. The clockwise rotation of the feed transport system 37 is synchronized with the counterclockwise rotation of an impression cylinder 45 so that the cylinder's paper gripper 47 or 48 secures the leading edge of each sheet 43 at the closest approach of each sheet to the impression cylinder. By securing the leading edge of each sheet 43, the sheet is transferred to the impression cylinder 45 and carried on the cylinder's surface to a delivery transport system 50.

In order to transfer the sheet 43 to the delivery transport system 50, an endless belt 51 containing paper grippers 53 is synchronized with the rotation of the impression cylinder 45 by a pair of rotating cylinders 55 and 57. At the closest approach to the delivery transport system 50 of each sheet 43, one of the grippers 53 secures the leading edge of the sheet to the endless belt 51; in coordination with this, gripper 47 or 48 releases the edge to free the sheet from the impression cylinder 45. From the impression cylinder 45, the delivery transport system 50 carries each sheet on the endless belt 51 to a delivery station 59 at which point the grippers 53 release the sheet onto a stack 61. It will be appreciated that synchronization between the grippers 47 or 48 and 49 and 53 is well known and can be accomplished by conventional means.

In accordance with one important aspect of the invention, an elastic roller 63 rotates in synchronization with the impression cylinder 45 and in contact with the cylinder so as to create a nip 65 between the surfaces of the cylinders through which each sheet must pass: at the nip, the first side of each sheet is varnished by the elastic roller 63 and the second side of each sheet is simultaneously perfected by an inked printing plate 67 or 68 secured to the impression cylinder 45. Thus, the sensitive operations of varnishing and perfecting are carried out in one pass. From the varnishing unit, the sheet 43 can be secured to the endless belt 51 by way of the grippers 53 and carried a relatively long distance to allow the sheet to dry without being touched and before being released at the delivery station 59.

Lithographic printing utilizing printing plates secured directly to the impression cylinder is commonly referred to as two-cylinder or di-litho printing. Each of the printing plates 67 and 68 is secured to the surface of the impression cylinder 45 by a pair of clamping mechanisms 69 and 70. Each of the clamping mechanisms 69 includes a screw 71 for tensioning the plates 67 and 68 onto the cylinder's surface. In order to ensure the clamping mechanisms do not interfere with the rotation of the impression cylinder 45, they are disposed in opposing channels 72 and 73. Also disposed in the channels 72 and 73 are the grippers 47 and 48, respectively.

In order to supply varnish to the elastic roller 63, metering and feed rollers 74 and 75 receive varnish from a reservoir 76 and evenly distribute it onto the elastic roller 63. In order to dampen and ink the lithographic plates 67 and 68 secured to the surface of the impression cylinder 45, a dampening unit 77 and an inking unit 79 are provided. The dampening unit 77, which dampens the plate 67 before it is inked, consists of a series of rollers that transmit in a well-known manner regularly controlled quantities of water taken up from a reservior. A series of rollers also form the inking unit 79. They spread the ink evenly over the surface of the impression cylinder 45. The ink is applied to the rollers and evenly distributed in a well-known manner.

Figure 5:
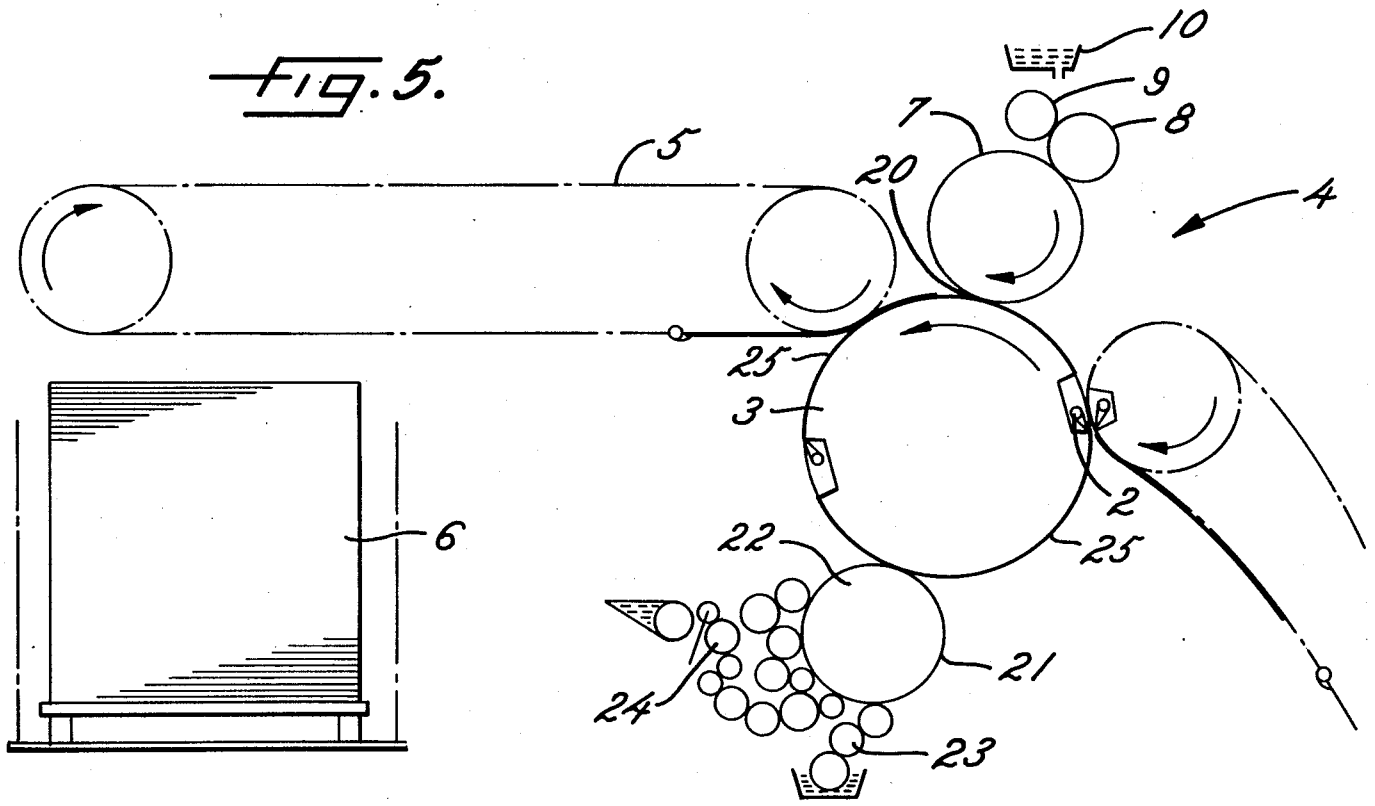
FIG. 5 is a schematic diagram of a perfecting and varnishing unit according to the invention which utilizes a three-cylinder offset perfecting process.

In an alternative embodiment of the varnishing unit according to the invention, the impression cylinder 45 in FIG. 5 has a rubber blanket 81 secured to its surface and a printing-plate cylinder 83 touching the blanket and rotating in synchronization with the impression cylinder. As in the FIG. 3 embodiment, the elastic roller 63 is rotating in contact and in synchronization with the impression cylinder 45 to create a nip 65 between the cylinders at which sheets 43 are simultaneously varnished and perfected. Varnish is applied to each sheet by the elastic roller 63 in the same manner as described in connection with the FIG. 3 embodiment. Metering and feed rollers 74 and 75 deliver varnish from the reservoir 76 to the elastic roller 63.

A lithographic plate 85, secured to the surface of printing plate cylinder 83, is dampened and inked by dampening unit 87 and inking unit 89, respectively. Since the rotating printing plate cylinder 83 is synchronized with the impression cylinder 45 and in contact with the cylinder's blanket 81, the ink is transferred to the blanket and printed on the sheets at the nip 65 in a well-known manner commonly identified as three-cylinder or offset printing.

The feeding and delivering systems for the sheets 43 associated with the varnishing unit of FIG. 5 are identical to that described in connection with FIG. 3; therefore a description of these systems will not be repeated. For ease of understanding, the apparatuses in the varnishing unit of FIG. 5 common to that in the varnishing unit of FIG. 3 are identified with the same numeral designations.

From the foregoing, it will be appreciated that the invention solves prior perfecting and varnishing problems by providing the impression cylinder 45 in contact and synchronization with the elastic cylinder 63 to form a nip between the cylinders through which sheets 43 pass and are thereby simultaneously varnished on their first sides and perfected on their second sides. The invention may be utilized in either a di-litho perfecting configuration or an offset perfecting configuration; although the di-litho perfecting process is preferred since in the offset perfecting process the sheets tend to adhere to the rubber blanket 81 unless the speed of the delivery transfer system is carefully matched to the impression cylinder. It has been found that a single color di-litho print varnished and perfected according to the invention meets the highest standards of quality.

We claim:

1. A method of printing and perfecting sheets for use in a printing machine having a rotatable impression cylinder and a rotatable varnishing cylinder in contact with said impression cylinder for providing a nip through which said sheets must pass, comprising the steps of supplying ink to said impression cylinder, supplying varnish to said varnishing cylinder, feeding successive sheets to said impression cylinder, carrying said sheets on said impression cylinder through said nip such that varnish is applied to and coats a first side of the sheets from said varnishing cylinder while ink is simultaneously transferred to an opposite side of said sheets from said impression cylinder, transferring said sheets away from said impression cylinder for sufficient time to permit drying of said ink and varnish, and then delivering said sheets to a delivery station.

2. The method of claim 1 including printing said first side of each said sheet before feeding the sheet to said impression cylinder.

3. The method of claim 1 including supplying ink to said impression cylinder by applying ink to at least one plate secured to said impression cylinder.

4. The method of claim 1 including supplying ink to said impression cylinder by applying ink to a blanket secured to said impression cylinder.

5. A method of printing and varnishing sheets that are previously printed on a first side comprising the steps of feeding successive sheets to a rotatable impression cylinder, carrying said sheets about said impression cylinder as an incident to rotation thereof, supplying ink to said impression cylinder, transferring ink to a second side of said sheet as it is carried by said impression cylinder, and applying a coating of varnish to said first side of said sheet as it is carried by said impression cylinder, transferring said sheets away from said impression cylinder for sufficient time to permit drying of said varnish and ink applied and transferred thereto, and then delivering said sheets to a delivery station.

6. The method of claim 5 including applying varnish to said sheets by a rotatable varnishing cylinder mounted in contact with said impression cylinder for providing a nip with said impression cylinder through which the sheets must pass as they are carried by said impression cylinder.

7. The method of claim 6 including simultaneously transferring ink from said impression cylinder to said sheets while said sheets pass through said nip.

* * * * *